US008749439B2

(12) United States Patent
Rao et al.

(10) Patent No.: US 8,749,439 B2
(45) Date of Patent: Jun. 10, 2014

(54) ULTRA-HIGH FREQUENCY (UHF)-GLOBAL POSITIONING SYSTEM (GPS) INTEGRATED ANTENNA SYSTEM FOR A HANDSET

(75) Inventors: Basrur Rama Rao, Lexington, MA (US); Jeffrey Michael Elloian, Charlton, MA (US); Eddie N. Rosario, Methuen, MA (US)

(73) Assignee: The MITRE Corporation, McLean, VA (US)

( * ) Notice: Subject to any disclaimer, the term of this patent is extended or adjusted under 35 U.S.C. 154(b) by 178 days.

(21) Appl. No.: 13/423,982

(22) Filed: Mar. 19, 2012

(65) Prior Publication Data

US 2013/0241783 A1 Sep. 19, 2013

(51) Int. Cl.
*H01Q 21/00* (2006.01)

(52) U.S. Cl.
USPC ..... 343/725

(58) Field of Classification Search
USPC ..... 343/725, 729, 829, 700 MS
See application file for complete search history.

(56) References Cited

U.S. PATENT DOCUMENTS

| | | | | |
|---|---|---|---|---|
| 6,160,512 | A * | 12/2000 | Desclos et al. | 343/700 MS |
| 7,088,302 | B2 * | 8/2006 | Louzir et al. | 343/769 |
| 7,091,917 | B2 * | 8/2006 | Jan et al. | 343/725 |
| 7,202,836 | B2 | 4/2007 | Ooi et al. | |
| 7,324,055 | B2 * | 1/2008 | Wan | 343/725 |
| 7,982,680 | B1 | 7/2011 | Lopez | |
| 2003/0030591 | A1 | 2/2003 | Gipson et al. | |
| 2011/0012802 | A1 | 1/2011 | Weinstein et al. | |

* cited by examiner

*Primary Examiner* — Hoang V Nguyen
(74) *Attorney, Agent, or Firm* — Sterne, Kessler, Goldstein & Fox P.L.L.C.

(57) ABSTRACT

Embodiments provide an integrated antenna system that enables dual-use operation (e.g., communications and navigation). In an embodiment, the integrated antenna system includes a sleeve monopole antenna system and stacked shorted annular ring (SAR) patch antenna system, which are compactly integrated to fit on a military handset or a smart phone. In an embodiment, the integrated antenna system enables communication in the 225-450 MHz Ultra-High Frequency (UHF) band and reception of various Global Navigation Satellite System (GNSS) bands.

22 Claims, 5 Drawing Sheets

400

400

500

ULTRA-HIGH FREQUENCY (UHF)-GLOBAL POSITIONING SYSTEM (GPS) INTEGRATED ANTENNA SYSTEM FOR A HANDSET

Statement under MPEP 310. The U.S. government has a paid-up license in this invention and the right in limited circumstances to require the patent owner to license others on reasonable terms as provided for by the terms of Contract No. FA 8721-11-C-0001, awarded by the U.S. Department of Defense.

FIELD OF THE INVENTION

The present invention relates generally to antenna systems.

BACKGROUND OF THE INVENTION

Communication radios that operate in the Ultra-High Frequency (UHF) band are becoming increasingly important for tactical military communications. Similarly, the ability to identify the location of the user through global navigation is essential, especially in military systems for tracking a foot soldier and for providing updated situational awareness and networking capabilities in a combat environment.

There is a need therefore for antenna systems that can combine wideband UHF communications with global navigation functions and yet be small enough to be mounted on a small receiver chassis of a size typically used in military handsets or smart phones.

BRIEF SUMMARY OF THE INVENTION

Embodiments provide an integrated antenna system that enables dual-use operation (e.g., communications and navigation). In an embodiment, the integrated antenna system includes a ferrite loaded sleeve monopole antenna system and stacked shorted annular ring (SAR) patch antenna system, which are compactly integrated to fit on a military handset or a smart phone. In an embodiment, the integrated antenna system enables communication in the 225-450 MHz Ultra-High Frequency (UHF) band and reception in the $L_1$ and $L_2$ frequency bands of the Global Positioning System (GPS). In addition, the system has sufficient gain-bandwidth to cover a frequency range from 1.164 to 1.606 GHz to provide reception of various Global Navigation Satellite System (GNSS) bands.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will be described with reference to the accompanying drawings. The drawing in which an element first appears is typically indicated by the leftmost digit(s) in the corresponding reference number.

DETAILED DESCRIPTION OF THE INVENTION

Embodiments provide antenna and an integrated antenna system that enables dual-use operation (e.g., communications and navigation). In an embodiment, the integrated antenna system includes a sleeve monopole antenna system and stacked shorted annular ring (SAR) patch antenna system, which are compactly integrated to fit on a military handset or a smart phone. In an embodiment, the integrated antenna system enables communication in the 225-450 MHz Ultra-High Frequency (UHF) band and reception of various Global Navigation Satellite System (GNSS) bands. Example embodiments of the integrated antenna system are now provided for the purpose of illustration.

Figure 1:
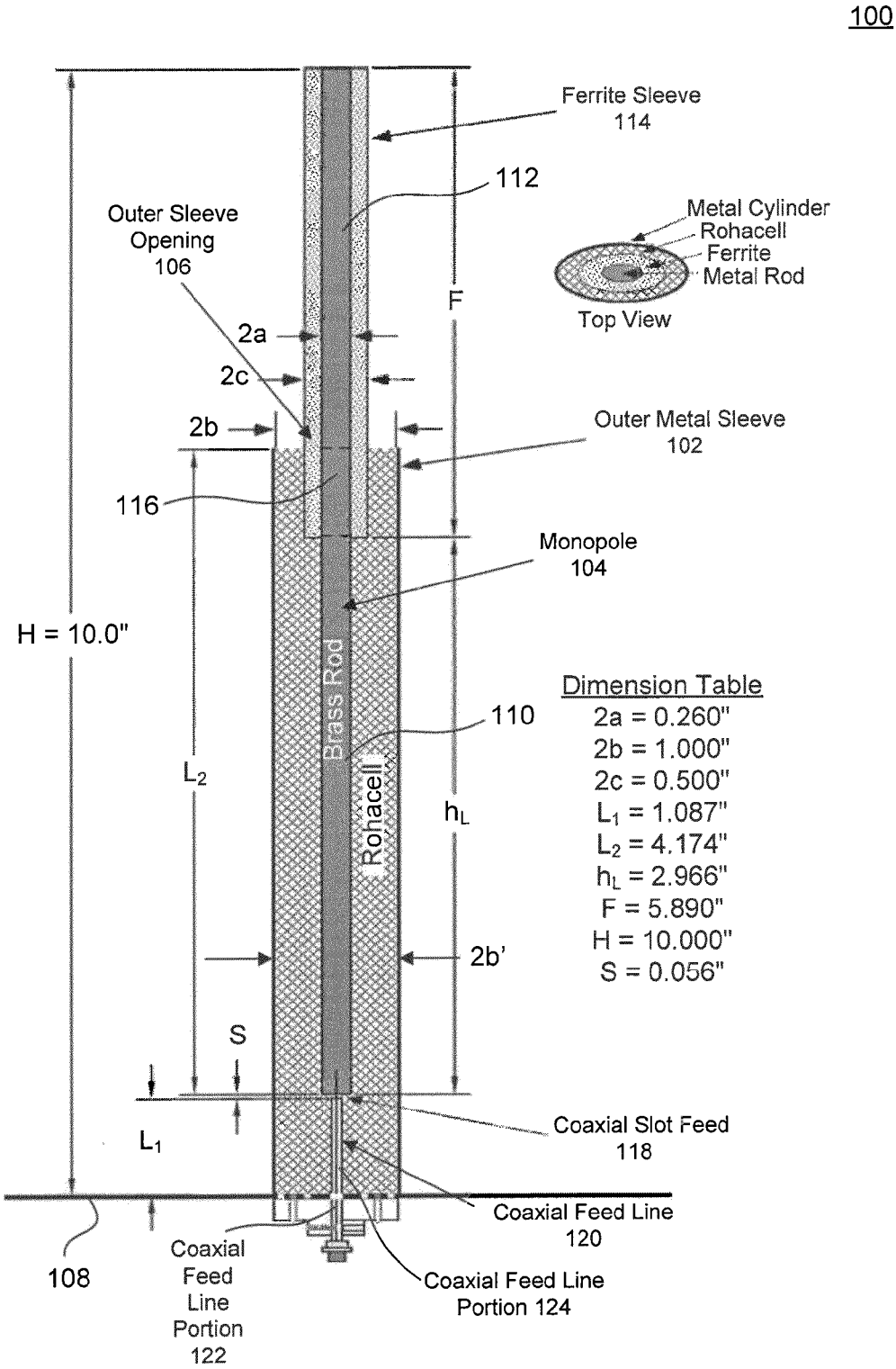
FIG. 1 is a cross-section of an example sleeve monopole antenna according to an embodiment of the present invention.

FIG. 1 is a cross-section of an example sleeve monopole antenna system 100 according to an embodiment of the present invention. Example sleeve monopole antenna system 100 is provided for the purpose of illustration and is not limiting. As shown in FIG. 1, example sleeve monopole system 100 includes an outer cylindrical metal sleeve 102, a monopole antenna element 104, a ferrite sleeve 114, and a coaxial feed line 120 terminating in a coaxial slot feed 118 of monopole antenna element 104.

Metal sleeve 102 has an inner diameter "2*b*" (see FIG. 1) with an opening 106. Outer metal sleeve 102 rests on the top surface of a ground plane 108. In example antenna 100, the inner diameter "2*b*" of metal sleeve 102 is equal to 1.0 inch. In an embodiment, metal sleeve 102 is fixed in an upright position, perpendicular to ground plane 108.

Monopole antenna element 104 is coaxially located at the center of outer metal sleeve 102. A portion of a top section 112 of monopole antenna element 104, which is covered by ferrite sleeve 114, extends above opening 106 of outer metal sleeve 102. In example antenna 100, the total height "H" of the structure extending from the top end of monopole antenna element 104 to the top surface of ground plane 108 is equal to 10.0 inches.

In an embodiment, monopole antenna element 104 is a cylindrical brass rod having an outer diameter "2*a*." In example antenna 100, the outer diameter "2*a*" of antenna element 104 is 0.26 inches. As such, foam material (e.g., Rohaceil) is used to fill the gap between antenna element 104 and the interior of metal sleeve 102.

Ferrite sleeve 114 penetrates metal sleeve 102 through opening 106 such that it encircles and covers a part of monopole antenna element 104. In an embodiment, ferrite sleeve 114 covers top section 112 and a portion of bottom section 110 of monopole antenna element 104, which is below the outer sleeve opening 106. Ferrite sleeve 114 has a total length "F" and an outer diameter "2*c*," In example antenna 100, the total length "F" and the outer diameter "2*c*" of ferrite sleeve 114 are equal to 5.89 inches and 0.50 inches, respectively.

Coaxial feed line 120 penetrates outer metal sleeve 102 from an opening located at the center of the metal surface covering the bottom of sleeve 102. The outer conducting sheath of coaxial feed line 120 is connected to the bottom metal cover of sleeve 102. In the embodiment shown in FIG. 1, the portion of coaxial feed line 120 that continues above the bottom surface of outer metal sleeve 102 (i.e., above ground plane 108) is referred to as coaxial feed line portion 124. The portion of coaxial feed line 120 located below the surface of ground plane 108 is referred to as coaxial feed line portion 122. Coaxial feed line portion 124 proceeds up to a distance of "$L_1$" above the surface of ground plane 108. The center conductor of coaxial feed line portion 124 is then connected to the center of monopole antenna element 104 at this point. A gap "s" is provided between the top surface of coaxial feed line portion 120 and the bottom surface of monopole antenna element 104. This gap "s" acts as the coaxial slot feed 118 for sleeve monopole antenna system 100. The top surface of coaxial slot feed 118 is at a distance "$L_2$" below opening 106 of metal sleeve 102 and at a distance "$h_L$" below the lower edge of ferrite sleeve 114. In example antenna system 100, the distances "$L_1$", "$L_2$", "$h_L$", and "s" are equal to 1.087, 4.174, 2.966, and 0.056 inches, respectively.

Embodiments are not limited to example antenna system 100 described above. For example, as would be understood by a person of skill in the art based on the teachings herein, any of the exemplary antenna dimensions described above may be configured, as needed, to meet design and/or performance constraints. As such, antenna system 100 offers a variety of design parameters which can be configured to optimize antenna performance and/or to satisfy design constraints. These design parameters include, for example and without limitation, the outer diameter "2*a*" of antenna element 104, the inner diameter "2*b*" of metal sleeve 102, the outer diameter "2*c*" of ferrite sleeve 114, the height "$L_I$" of the top surface of coaxial feed line 120 above the surface of ground plane 108 the distance "$L_2$" between opening 106 and the top surface of coaxial slot feed 118, the gap distance "s" of coaxial slot feed 118, the total length "F" of ferrite sleeve 114, and the distance "$h_L$" between the lower edge of ferrite sleeve 114 and the top surface of coaxial slot feed 118.

According to embodiments, one or more of the above listed (and other) design parameters may be configured to achieve desired antenna return loss and/or gain over a frequency band of interest. In an embodiment, the parameters are configured to achieve, at minimum, a return loss of −10 dB and a gain of 0 dBi over the 225-450 MHz Ultra High Frequency (UHF) band. The −10 dB return loss obviates the need for an external impedance matching network for the antenna, thereby reducing the size cost, and complexity of the antenna, and improves the antenna's radiation efficiency by eliminating the resistive loss of the impedance matching network.

Operating with adequate gain/return loss over a wide bandwidth places severe constraints on the minimum size of the antenna. For example, typically, a conventional monopole antenna supporting the 225-450 MHz UHF band has a total height "H" that is no less than 13 inches (13.12 inches being the quarter of the free space wavelength at 225 MHz). Reducing the size of the antenna generally reduces its bandwidth, gain, and radiation efficiency.

According to embodiments, one or more of the above listed (and other) design parameters may be configured to meet design size constraints. In an embodiment, antenna system 100 is configured for operation in the 225-450 MHz UHF band (at desired return loss and/or gain) while meeting size constraints (e.g., total height "H" below a certain length) required for installation on top of a handheld device. Extension of the band of operation to 512 MHz can be achieved in other embodiments.

In example implementations, antenna system 100 was designed with total height "H" configurations of 10 inches (without impedance matching network), 7.5 inches (with impedance matching network), and 5 inches (with impedance network). These configurations represent height reductions of 24%, 43%, and 62%, respectively, compared to a conventional design.

In embodiments, significant height reductions are achieved by virtue of ferrite sleeve 114, which covers a part of monopole antenna element 104 as described above. In particular, in an embodiment, as further described below, ferrite sleeve 114 is formed from an appropriately selected magneto-dielectric material, which allows for the height of monopole antenna element 104 to be reduced while maintaining the desired wide bandwidth performance of the monopole. Specifically, as further described below, the selected magneto-dielectric material is characterized by a high magnetic permeability and low magnetic loss in the frequency band of interest, such that ferrite sleeve 114 causes a reduction in the effective electrical length of monopole antenna element 104 when fitted around it as shown in FIG. 1.

The electrical wavelength in the ferrite material is given by $$\lambda_f = \frac{\lambda_0}{\sqrt{\mu_r \varepsilon_r}},$$

where $\lambda_0$ is the electrical wavelength in free-space, $\mu_r$ is the real component of the relative magnetic permeability of the ferrite material, and $\in_r$ is the real component of the relative complex dielectric permittivity of the ferrite material. $n_f = \sqrt{\mu_r \in_r}$ is refractive index of the ferrite material.

According to embodiments, the selected ferrite material is one with the following properties for its magnetic permeability and dielectric permittivity:

- To achieve a significant reduction in the height of the antenna, the refractive index $n_f$ needs to be high. Hence, the relative magnetic permeability and the dielectric permittivity in the desired band must both be high.
- The real component of the relative magnetic permeability $\mu_r$ must be nearly equal to the real component of the relative complex dielectric permittivity $\in_r$. This allows the intrinsic impedance of the ferrite material $$n_f = \eta_0 \sqrt{\frac{\mu_r}{\varepsilon_r}}$$

to be approximately equal to the intrinsic impedance of free-space, $$\eta_0 = \sqrt{\frac{\mu_0}{\varepsilon_0}}.$$

As such, the gain-bandwidth product of the antenna is greatly improved as the antenna can be more easily impedance matched to free-space.

The magnetic loss tangent $$\delta_M = \frac{\mu_i}{\mu_r}$$

($\mu_i$ is the imaginary component of the relative magnetic permeability) and the dielectric loss tangent $$\delta_D = \frac{\varepsilon_i}{\varepsilon_r}$$

($\in_t$ is the imaginary component of the relative complex dielectric permittivity) must both be low in the frequency band of interest. Specifically, $\mu_i$ and $\in_i$ must be reduced to the lowest level possible in order to maintain good antenna efficiency, since they represent the magnetic and dielectric losses in the ferrite material.

In an embodiment, the selected magneto-dielectric material is a Z type $Co_2Z$ Barium Hexagonal ferrite ($Ba_3Co_2Fe_{24}O_{41}$). This material has on average a magnetic permeability of 7.5 and a magnetic loss tangent of 0.06 between 225 and 450 MHz.

In addition to the selected material type, the above described design parameters associated with ferrite sleeve 114 (i.e., the diameter "2*c*" of ferrite sleeve 114, the total length "F" of ferrite sleeve 114, and the distance "4" between the lower edge of ferrite sleeve 114 and coaxial slot feed 118) also affect the extent to which the height of the antenna can be reduced. For example, increasing the total length "F" of ferrite sleeve 114 by further penetrating into metal sleeve 102 (i.e., decreasing the distance "$h_L$" between the lower edge of ferrite sleeve 114 and coaxial slot feed 118) can be used to further reduce the antenna height. However, the radiation efficiency of the antenna begins to decrease with the distance "$h_L$" below a certain threshold.

Figure 2:
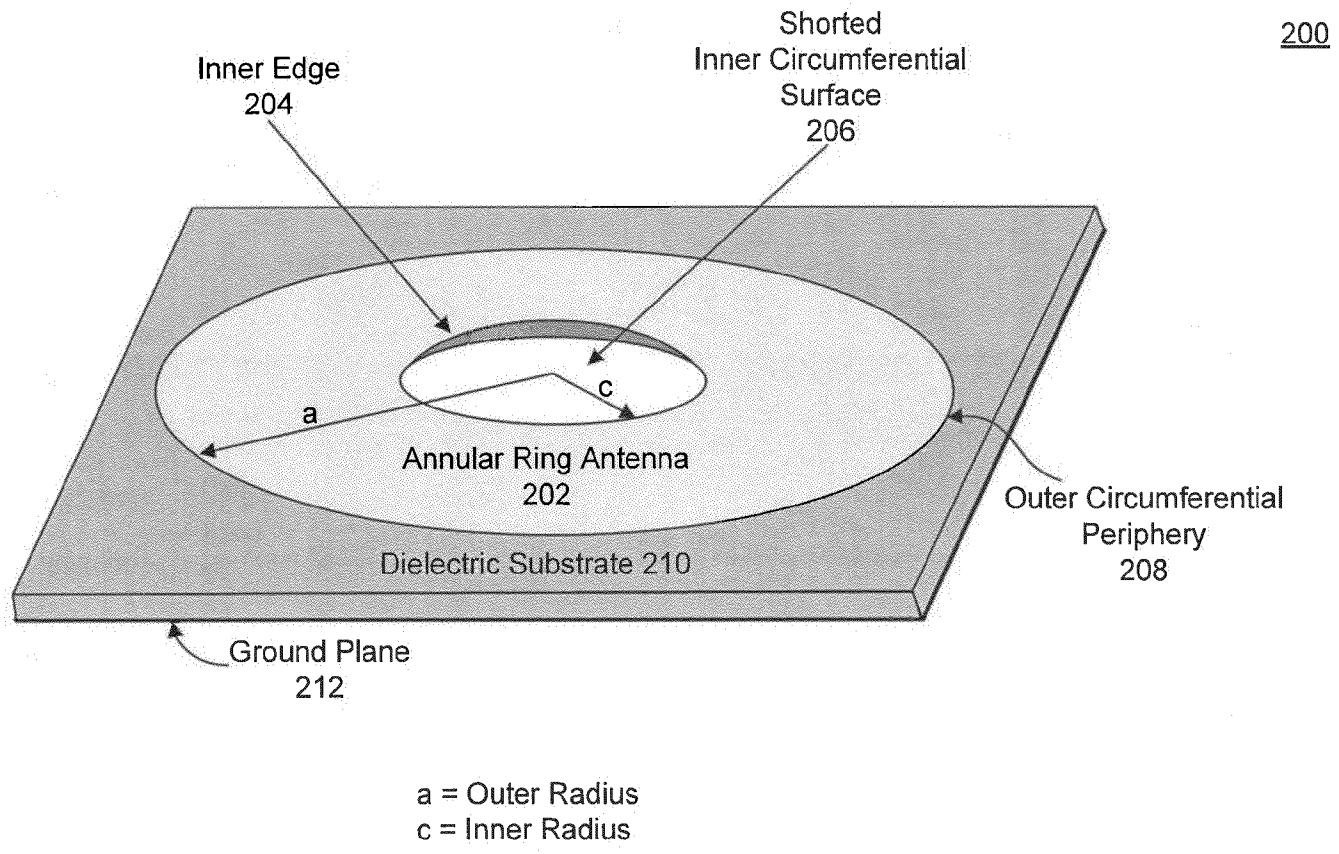
FIG. 2 is a three-dimensional view of an example shorted annular ring (SAR) patch antenna according to an embodiment of the present invention.

FIG. 2 is a three-dimensional view of an example shorted annular ring (SAR) patch antenna 200 according to an embodiment of the present invention. Example SAR patch antenna 200 is provided for the purpose of illustration and is not limiting. As shown in FIG. 2, example SAR patch antenna 200 includes an annular ring antenna 202 consisting of a thin, electro-deposited layer of metal (e.g., copper) on top of a dielectric substrate layer 210. In an embodiment, dielectric substrate 210 is formed on top of a ground plane 212.

In an embodiment, annular ring antenna 202 is formed by depositing a thin circular metallic layer on top of dielectric substrate 210 and then drilling a hole through the metallic layer and dielectric substrate 210. An inner circumferential gap surface 206 is thus formed, giving annular ring antenna 202 an inner radius ("c" in FIG. 2) and an outer radius ("a" in FIG. 2). In embodiments, one or more of the inner radius and outer radius of annular ring antenna 202 can be adjusted to configure the radiation pattern, resonance frequency, and/or gain of antenna 202.

In addition, annular ring antenna 202 has an inner edge 204 and an outer circumferential periphery 208. In an embodiment, inner edge 204 is electrically shorted by being coupled to ground plane 212. As such, annular ring antenna 202 is referred to as a shorted annular ring (SAR). By coupling inner edge 204 to ground, no radiation emanates from inner edge 204 and antenna 202 is configured to emanate from outer circumferential periphery 202 only. In addition, inner edge 204 provides an electro-static discharge (ESD) path to ground for antenna 202.

Figure 3:
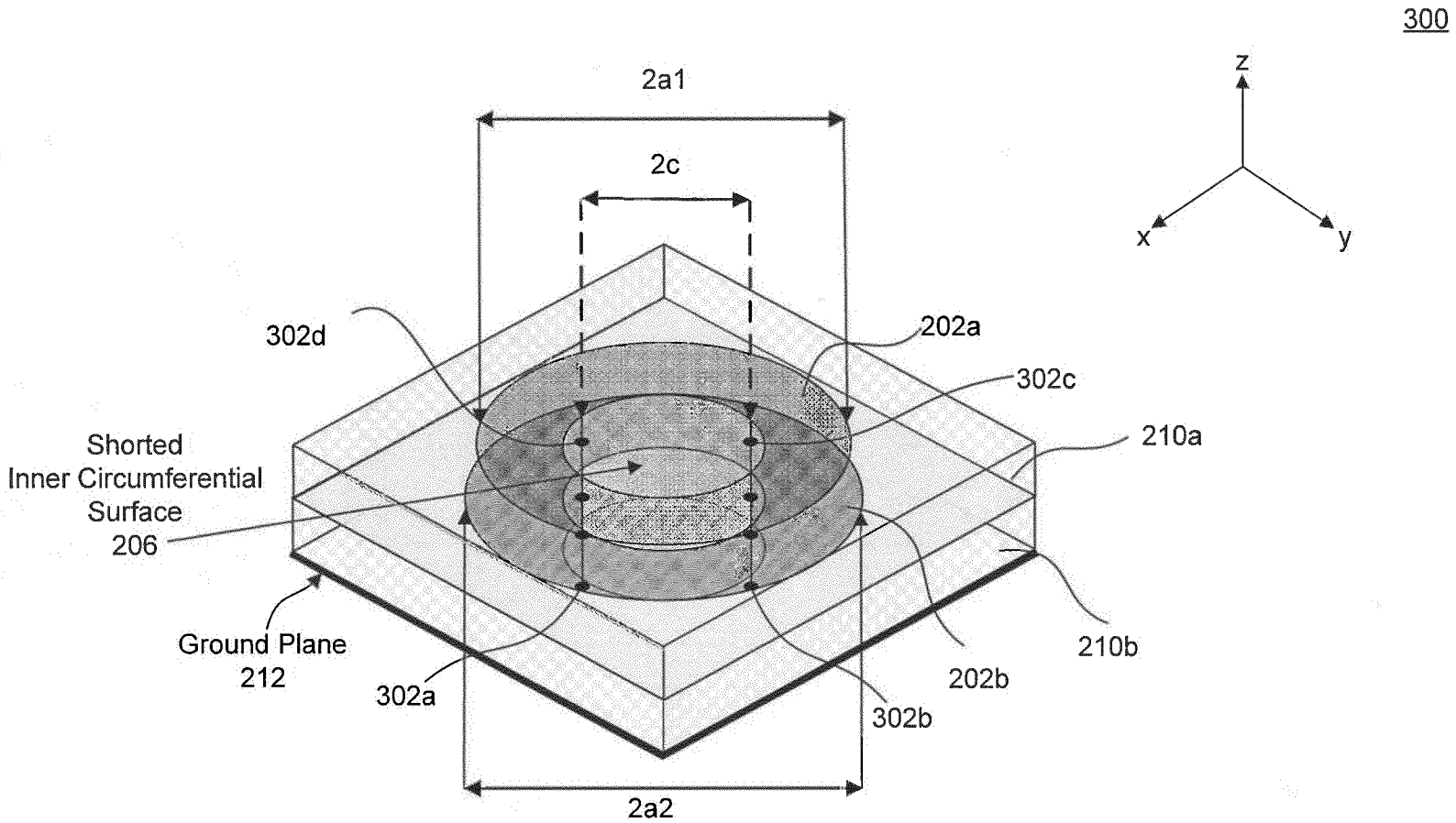
FIG. 3 is a three-dimensional view of an example stacked SAR patch antenna according to an embodiment of the present invention.

FIG. 3 is a three-dimensional view of an example dual band, stacked SAR patch antenna system 300 according to an embodiment of the present invention. Example antenna system 300 is provided for the purpose of illustration and is not limiting. Example antenna system 300 includes two SAR patch antennas that are concentrically stacked (i.e., share same center axis) in parallel planes. In other embodiments, as would be understood by a person of skill in the art based on the teachings herein, antenna system 300 may have more than two stacked SAR patch antennas.

As shown in FIG. 3, each of the SAR antennas includes an annular ring antenna 202*a*/202*b*, which is formed in a respective dielectric substrate 210*a*/210*b*, as described above in FIG. 2. Dielectric substrates 210*a* and 210*b* may be of same or different dielectric materials.

In an embodiment, annular ring antennas 202*a* and 202*b* have equal inner radii or inner diameter ("2*c*" in FIG. 3). A cylindrical gap is thus formed inside antenna system 300 along the vertical z-axis as shown in FIG. 3. The cylindrical gap has a cross-sectional surface (in the horizontal xy plane) that corresponds to inner circumferential gap surface 206, described above in FIG. 2.

Annular ring antennas 202*a* and 202*b* may have equal or different outer radii or outer diameters ("2*a*1" and "2*a*2" in FIG. 3). In an embodiment, the respective outer radii of annular ring antennas 202*a* and 202*b* are configured such that the annular ring antenna 202*a* resonates in a first frequency band and annular ring antenna 202*b* resonates in a second frequency band. For example, without limitation, the first and second frequency bands may correspond, to the Global Positioning System (GPS) L1 band and GPS L2 band, respectively. Other Global Navigation Satellite System (GNSS) bands including other GPS bands, Galileo bands, GLONASS bands, COMPASS bands, and Iridium bands may also be supported.

In an embodiment, example antenna system 300 is formed on top of a ground plane (not shown in FIG. 3). The respective inner edges (see inner edge 204 in FIG. 2) of annular ring antennas 202*a* and 202*b* may be electrically shorted by being coupled to the ground plane. By coupling the inner edges to ground, no radiation emanates from the inner edges and antennas 202*a-b* are configured to emanate from their outer circumferential peripheries (see outer circumferential periphery 202 in FIG. 2) only. In addition, each of the inner edges provides an electro-static discharge (ESD) path to ground for its respective antenna 202. In an embodiment, the inner edges of antennas 202*a-b* are coupled to the ground plane via an element of another antenna system placed inside the cylindrical gap of antenna system 300. For example, in an embodiment, outer metal sleeve 102 of sleeve monopole system 100, described above in FIG. 1, is placed inside the cylindrical gap of SAR antenna system 300, thereby coupling the inner edges of antennas 202*a-b* to the ground plane.

According to embodiments, antennas 202*a-b* may each be fed in a variety of ways according to the desired radiation pattern. In an embodiment, each of antennas 202*a-b* includes a plurality of coaxial feed probes 302*a-d* located at selected distances from the center of the annular ring. In an embodiment, the distances of coaxial feed probes 302*a-b* from the center are configured to provide a desired impedance match (e.g., 50 Ohms) for antenna system 300. In another embodiment, coaxial feed probes 302*a-b* are placed symmetrically at azimuth intervals of 90 degrees around the circumference of the annular ring. This configuration allows antennas 202*a-b* to produce an azimuthally symmetric radiation pattern with good RHCP (right-handed circular polarization) axial ratio. The center conductors of each of coaxial feed probes 302*a-b* are soldered only to (top) annular ring antenna 202*a*. Care is taken to ensure that the center conductors of coaxial feed probes 302*a-b* do not make electrical contact with (bottom) annular ring antenna 202*b*. Instead, these center conductors proceed clearly through a sufficiently large clearance hole provided in annular ring antenna 202*b* without touching annular ring antenna 202*b*.

Figure 4:
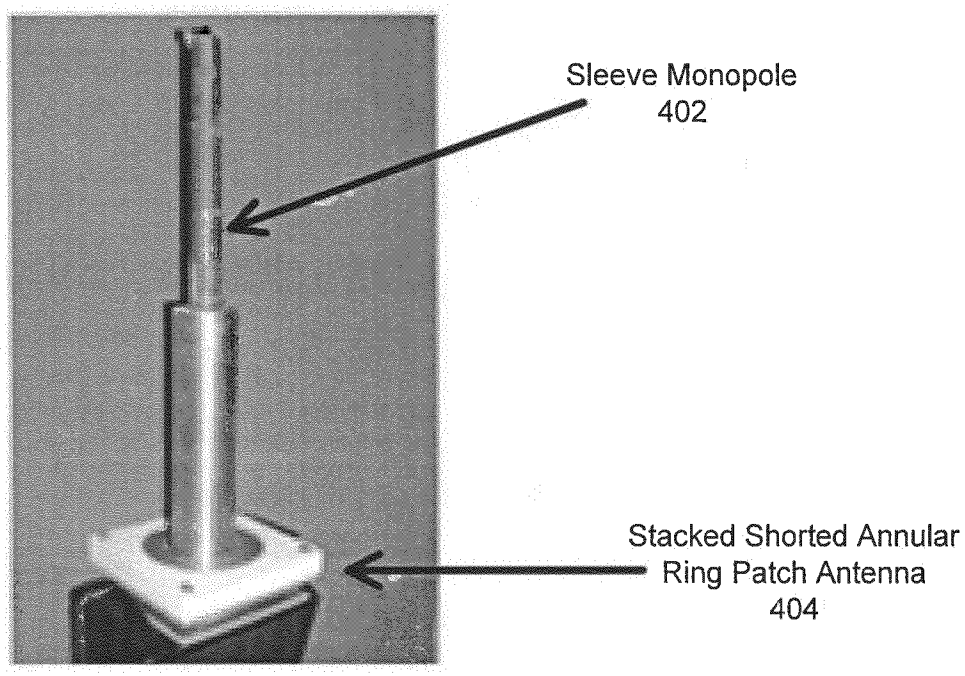
FIG. 4 illustrates an example integrated antenna system according to an embodiment of the present invention.

FIG. 4 illustrates an example integrated antenna system 400 according to an embodiment of the present invention. Example antenna system 400 is provided for the purpose of illustration and is not limiting. As shown in FIG. 4, example system 400 include a sleeve monopole antenna system 402 integrated with a stacked SAR patch antenna system 404. Sleeve monopole antenna system 402 may be an embodiment of example antenna system 100 described in FIG. 1 above. Stacked SAR patch antenna system 404 may be an embodiment of example antenna system 300 described in FIG. 3 above.

As shown in FIG. 4, stacked SAR patch antenna system 404 encircles and is fitted around the base of the outer cylindrical metal sleeve (see outer metal sleeve 102 in FIG. 1) of sleeve monopole antenna system 402. The integrated systems thus provides a single, co-located and compact dual-use antenna system (e.g., communications and navigation).

In an embodiment, the outer diameter of the outer metal sleeve of antenna system 402 and the common inner radius of the plurality of annular ring antennas of antenna system 404 are configured to be substantially equal such that the cylindrical metal sleeve is in contact with the respective inner edges of the plurality of annular ring antennas. With the outer metal sleeve of antenna system 402 sitting on a ground plane, the respective inner edges of the plurality of annular ring antennas of antenna system 404 may be electrically shorted, allowing the radiation of each annular ring antenna to emanate from its respective outer circumferential periphery (i.e., in a horizontal plane in FIG. 4).

To minimize interference and coupling between the two antenna systems 402 and 404, the radiating surface of the monopole element of antenna system 402 is made substantially orthogonal to the radiating surfaces of antenna system 404. This is done by configuring one or more of the design parameters of antenna system 402 (described above in FIG. 1) such that radiation from antenna system 402 does not emanate in the horizontal planes occupied by radiation from antenna system 404. In addition, antenna system 404 can be configured to be vertically very thin (e.g., 0.4 inches) relative to the height of antenna system 402 (e.g., the height "$L_1$" of coaxial feed sleeve 120 above ground plane 108 is 1.087 inches in example antenna system 100). The electrical shorting of the inner edges of the annular ring antennas of antenna system 404 also ensure that the presence of antenna system 402 at its center does not affect its radiation pattern.

In an embodiment, integrated antenna system 400 is configured to provide a multi-function antenna that provides a capability for both wideband UHF communications and GNSS satellite navigation. For example, integrated antenna system 400 may be configured for a military handset that is required to transmit/receive in the 225-450 MHz UHF band and to receive navigation signals from one or more bands of GPS, Galileo, GLONASS, COMPASS, and Iridium navigation systems.

Figure 5:
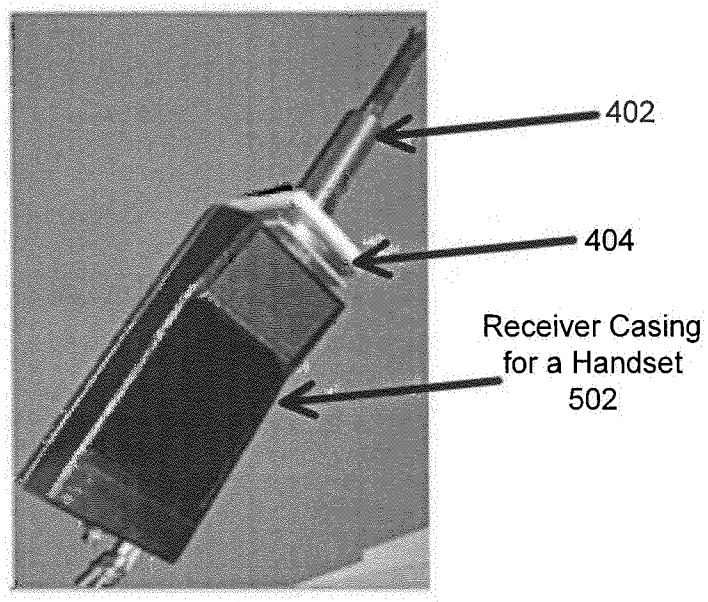
FIG. 5 illustrates an example handset with the integrated antenna system mounted thereon according to an embodiment of the present invention.

FIG. 5 illustrates an example handset 500 with example integrated antenna system 400 mounted thereon according to an embodiment of the present invention. As shown, integrated antenna system 400 is mounted on top of a receiver casing 502 of handset 500. In example implementations, antenna system 400 was designed with height and width configurations of 10 and 1.2 inches, 7.5 and 1.2 inches, and 5 and 1.2 inches. Receiver casing 502 was 8.5 inches long and had a cross-section of 4×2.5 inches.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An apparatus, comprising:

a first antenna system, comprising:

an outer cylindrical metal sleeve having an outer sleeve opening and an outer diameter;

a monopole antenna coaxially located inside the outer cylindrical metal sleeve, the monopole antenna having a top section that extends above the outer sleeve opening and a bottom section that extends below the outer sleeve opening into the outer cylindrical metal sleeve; and a ferrite sleeve that penetrates the outer cylindrical metal sleeve through the outer sleeve opening, the ferrite sleeve covering the top section and a portion of the bottom section of the monopole antenna; and a second antenna system, comprising:

a plurality of annular ring patch antennas, each of the annular ring patch antennas formed in a respective dielectric substrate, the plurality of annular ring patch antennas concentrically stacked in parallel planes and having a common inner radius, wherein the outer diameter of the outer cylindrical metal sleeve of the first antenna system and the common inner radius of the plurality of annular ring patch antennas of the second antenna system are configured such that the second antenna system encircles and fits to the first antenna system at a base portion of the outer cylindrical metal sleeve.

2. The apparatus of claim 1, further comprising:

a ground plane, wherein the outer cylindrical metal sleeve of the first antenna system is perpendicular to the ground plane.

3. The apparatus of claim 1, wherein the ferrite sleeve is formed from a magneto-dielectric material.

4. The apparatus of claim 3, wherein the magneto-dielectric material is a Z type $Co_2Z$ Barium Hexagonal ferrite.

5. The apparatus of claim 1, wherein the monopole antenna includes a coaxial slot feed, the first antenna system further comprising:

a coaxial feed line that penetrates the outer cylindrical metal sleeve from a bottom opening, the coaxial feed line configured to couple to the coaxial slot feed.

6. The apparatus of claim 1, wherein the first antenna system is configured to resonate in a 225-450 MHz Ultra High Frequency (UHF) band without an external impedance matching network coupled to it.

7. The apparatus of claim 1, wherein the first antenna system is configured to resonate in a 225-512 MHz UHF band by coupling an external impedance matching network to it.

8. The apparatus of claim 1, wherein each of the plurality of annular ring patch antennas has an inner edge, the inner edge coupled to a ground plane.

9. The apparatus of claim 8, wherein the inner edge is configured to be non-radiating.

10. The apparatus of claim 9, wherein each of the plurality of annular ring patch antennas has a respective outer circumferential periphery and is configured to emanate radiation from the respective outer circumferential periphery.

11. The apparatus of claim 8, wherein the inner edge is configured to provide an electro-static discharge (ESD) path for the annular ring patch antenna.

12. The apparatus of claim 1, wherein each of the plurality of annular ring patch antennas includes a plurality of feed probes, the plurality of feed probes located at selected distances from a center of the annular ring patch antenna, configured to provide a desired impedance match for the second antenna system.

13. The apparatus of claim 1, wherein each of the plurality of annular ring patch antennas has a respective outer radius, the plurality of annular ring patch antennas comprising:

a first annular ring patch antenna having a first outer radius, the first outer radius configured such that the first annular ring patch antenna resonates in a first frequency band; and a second annular ring patch antenna having a second outer radius, the second outer radius configured such that the second annular ring patch antenna resonates in a second frequency band.

14. The apparatus of claim 13, wherein the first frequency band corresponds to the Global Positioning System (GPS) L1 band and the second frequency band corresponds to the GPS L2 band.

15. The apparatus of claim 1, wherein the second antenna system operates in one or more of: the Global Positioning System (GPS) L1 band, GPS L2 band, GPS L5 band, and the Global Navigation Satellite System (GNSS) 1.164-1.606 GHz band.

16. An apparatus, comprising:

a first antenna system, comprising:

an outer cylindrical metal sleeve having an outer sleeve opening;

a monopole antenna coaxially located inside the outer cylindrical metal sleeve, the monopole antenna having a top section that extends above the outer sleeve opening and a bottom section that extends below the outer sleeve opening into the outer cylindrical metal sleeve; and a ferrite sleeve that penetrates the outer cylindrical metal sleeve through the outer sleeve opening, the ferrite sleeve covering the top section and a portion of the bottom section of the monopole antenna; and a second antenna system, comprising a plurality of concentrically stacked annular ring patch antennas, wherein the second antenna system encircles a base portion of the outer cylindrical metal sleeve of the first antenna system.

17. The apparatus of claim 16, wherein the ferrite sleeve is formed from a magneto-dielectric material.

18. The apparatus of claim 17, wherein the magneto-dielectric material is a Z type $Co_2Z$ Barium Hexagonal ferrite.

19. An apparatus, comprising:

a first antenna system, comprising an outer cylindrical metal sleeve; and a second antenna system, comprising:

a plurality of concentrically stacked annular ring patch antennas, each of the plurality of annular ring patch antennas having an inner edge and an outer radius, the inner edge coupled to a ground plane, and wherein the plurality of concentrically stacked annular ring patch antennas comprise:

a first annular ring patch antenna having a first outer radius, the first outer radius configured such that the first annular ring patch antenna resonates in a first frequency band; and a second annular ring patch antenna having a second outer radius, the second outer radius configured such that the second annular ring patch antenna resonates in a second frequency band, wherein the second antenna system encircles a base portion of the outer cylindrical metal sleeve of the first antenna system.

20. The apparatus of claim 19, wherein each of the plurality of annular ring patch antennas has a respective outer circumferential periphery and is configured to emanate radiation from the respective outer circumferential periphery.

21. The apparatus of claim 19, wherein the first frequency band corresponds to the Global Positioning System (GPS) L1 band and the second frequency band corresponds to the GPS L2 band.

22. The apparatus of claim 19, wherein the inner edge is configured to provide an electro-static discharge (ESD) path for the annular ring patch antenna.

* * * * *